US010249308B2

(12) United States Patent
Sung et al.

(10) Patent No.: US 10,249,308 B2
(45) **Date of Patent: *Apr. 2, 2019**

(54) WEIGHT FUNCTION DETERMINATION DEVICE AND METHOD FOR QUANTIZING LINEAR PREDICTION CODING COEFFICIENT

(71) Applicant: SAMSUNG ELECTRONICS CO., LTD., Suwon-si (KR)

(72) Inventors: Ho-sang Sung, Yongin-si (KR); Eun-mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,369

(22) Filed: Sep. 10, 2018

(65) Prior Publication Data

US 2019/0019524 A1 Jan. 17, 2019

Related U.S. Application Data

(63) Continuation of application No. 15/112,006, filed as application No. PCT/KR2015/000453 on Jan. 15, 2015, now Pat. No. 10,074,375.

(30) Foreign Application Priority Data

Jan. 15, 2014 (KR) ..... 10-2014-0005318

(51) Int. Cl.
*G10L 19/032* (2013.01)
*G10L 21/00* (2013.01)
(Continued)

(52) U.S. Cl.
CPC ..... *G10L 19/032* (2013.01); *G10L 19/06* (2013.01); *G10L 19/07* (2013.01); *G10L 19/12* (2013.01);
(Continued)

(58) Field of Classification Search
CPC ..... G10L 19/032; G10L 21/00; G10L 19/00; G10L 19/07
(Continued)

(56) References Cited

U.S. PATENT DOCUMENTS 8,812,307 B2 * 8/2014 Xu ..... G10L 19/022 704/219
9,236,059 B2 * 1/2016 Sung ..... G10L 19/07
(Continued)

FOREIGN PATENT DOCUMENTS

JP 2009244723 A 10/2009
KR 100579797 B1 5/2006
(Continued)

OTHER PUBLICATIONS

Chang et al., "Efficient quantization of LSF parameters using classified SVQ combined with conditional splitting." Acoustics, Speech, and Signal Processing, 1995, ICASSP-95., International Conference on. vol. 1. IEEE. (Year: 1995).*
(Continued)

*Primary Examiner* — Seong-Ah A Shin
(74) *Attorney, Agent, or Firm* — Sughrue Mion, PLLC

(57) ABSTRACT

A weighting function determination method includes obtaining a line spectral frequency (LSF) coefficient or an immitance spectral frequency (ISF) coefficient from a linear predictive coding (LPC) coefficient of an input signal and determining a weighting function by combining a first weighting function based on spectral analysis information and a second weighting function based on position information of the LSF coefficient or the ISF coefficient.

20 Claims, 12 Drawing Sheets

(51) Int. Cl.

| | |
|---|---|
| ***G10L 19/00*** | (2013.01) |
| ***G10L 19/07*** | (2013.01) |
| ***G10L 25/15*** | (2013.01) |
| ***G10L 19/12*** | (2013.01) |
| ***G10L 19/06*** | (2013.01) |

(52) U.S. Cl.
CPC ..... *G10L 25/15* (2013.01); *G10L 2019/0016* (2013.01)

(58) Field of Classification Search
USPC ..... 704/206, 219, 500
See application file for complete search history.

(56) References Cited

U.S. PATENT DOCUMENTS

| | | | | |
|---|---|---|---|---|
| 9,311,926 | B2 | 4/2016 | Sung et al. | |
| 9,773,507 | B2 * | 9/2017 | Sung | G10L 19/06 |
| 2002/0029140 | A1 * | 3/2002 | Ozawa | G10L 19/07 704/219 |
| 2010/0094637 | A1 * | 4/2010 | Vinton | G10L 19/03 704/500 |
| 2010/0280823 | A1 * | 11/2010 | Shlomot | G10L 19/012 704/201 |
| 2011/0099004 | A1 * | 4/2011 | Krishnan | G10L 21/038 704/206 |
| 2012/0095756 | A1 * | 4/2012 | Sung | G10L 19/06 704/219 |
| 2015/0332688 | A1 * | 11/2015 | Liu | G10L 19/02 704/500 |
| 2016/0336018 | A1 * | 11/2016 | Sung | G10L 19/07 |

FOREIGN PATENT DOCUMENTS

| | | | |
|---|---|---|---|
| KR | 1020110130290 | A | 12/2011 |
| KR | 1020110132435 | A | 12/2011 |
| KR | 1020120039865 | A | 4/2012 |
| WO | 2012/053798 | A2 | 4/2012 |

OTHER PUBLICATIONS

Kuldip K. Paliwal et al., "Effficient Vector Quantization of LPC Parameters at 24 Bits/Frame", IEEE Transactions on Speech and Audio Processing, vol. 1, No. 1, Jan. 1993, pp. 3-14, XP000358435.
Hai Le Vu et al., "A New General Distance Measure for Quantization of LSF and Their Treanformed Coefficients", Proceedings of the IEEE 1998 IEEE International Conference on Acoustics, Speech, and Signal Processing. ICASSP '98, vol. 1, 1998, pp. 45-48, XP-000854511.
Carlos R. Ferreira et al., "Modified Interpolation of LSFs Based on Optimization of Distortion Measures", Telecommunications Symposium, 2006 International IEEE, pp. 777-782, XP031204122.
International Telecommunication Union., "ITU-T G.718 Frame error robust narrow-band and wideband embedded variable bit-rate coding of speech and audio from 8-32 kbit/s", Telecommunication Standardization Sector of ITU, Series G: Transmission Systems and Media, Digital Systems and Networks, Digital terminal equipments—Coding of voice and audio signals, 2008, 257 Total Pages, XP55087883.
Communication dated May 4, 2017, from the European Patent Office in counterpart European Application No. 15737834.0.
International Search Report and Written Opinion (PCT/ISA/210 & 237) dated Mar. 27, 2015, issued by the International Searching Authority in counterpart International Application No. PCT/KR2015/000453.
Chang et al., "Efficient quantization of LSF parameters using classified SVQ combined with conditional splitting." Acoustics, Speech, and Signal Processing, 1995. ICASSP-95., International Conference on. vol. 1. IEEE.

* cited by examiner

WEIGHT FUNCTION DETERMINATION DEVICE AND METHOD FOR QUANTIZING LINEAR PREDICTION CODING COEFFICIENT

RELATED APPLICATIONS

This application is a continuation application of U.S. patent application Ser. No. 15/112,006, filed on Jul. 15, 2016, which is a National stage entry of International Application No. PCT/KR2015/000453, filed on Jan. 15, 2015, which claims the benefit of Korean Patent Application No. 10-2014-0005318, filed on Jan. 15, 2014, in the Korean Intellectual Property Office, the disclosures of which are incorporated by reference herein in their entirety.

TECHNICAL FIELD

One or more exemplary embodiments relate to a weighting function determination apparatus and method, whereby the significance of a linear predictive coding (LPC) coefficient may be more accurately reflected to quantize the LPC coefficient, and a quantization apparatus and method using the same.

BACKGROUND ART

In the related art, linear predictive coding has been applied to encode a speech signal and an audio signal. A code excited linear prediction (CELP) coding technology has been employed for linear prediction. The CELP coding technology may use an excitation signal and a linear predictive coding (LPC) coefficient with respect to an input signal. When coding the input signal, the LPC coefficient may be quantized. However, quantizing of the LPC may have a narrowing dynamic range and may have difficulty in verifying a stability.

In addition, a codebook index for reconstructing an input signal may be selected in a decoding stage. When all the LPC coefficients are quantized with the same significance, deterioration may occur in a quality of a finally synthesized input signal. That is, since all the LPC coefficients have a different significance, a quality of the input signal may be enhanced when an error of an important LPC coefficient is small. However, when the quantization is performed by applying the same significance without considering that the LPC coefficients have a different significance, the quality of the input signal may be deteriorated.

Accordingly, there is a need for a method that may effectively quantize an LPC coefficient and may enhance a quality of a synthesized signal when reconstructing an input signal using a decoder. In addition, there is a desire for a technology that may have an excellent coding performance in a similar complexity.

DISCLOSURE

Technical Problems

One or more exemplary embodiments include a weighting function determination apparatus and method, which more accurately reflect significance of an LPC coefficient to quantize the LPC coefficient, and a quantization apparatus and method using the same.

Technical Solution

According to one or more exemplary embodiments, a method includes: obtaining a line spectral frequency (LSF) coefficient or an immitance spectral frequency (ISF) coefficient from a linear predictive coding (LPC) coefficient of an input signal; and combining a first weighting function based on spectral analysis information and a second weighting function based on position information of the LSF coefficient or the ISF coefficient to determine a weighting function.

The determining of the weighting function may include normalizing the ISF coefficient or the LSF coefficient.

The first weighting function may be obtained by combining a magnitude weighting function and a frequency weighting function.

The magnitude weighting function may be relevant to a spectral envelope of the input signal and may be determined by using a spectral magnitude of the input signal.

The magnitude weighting function may be determined by using sizes of one or more spectrum bins corresponding to a frequency of the ISF coefficient or the LSF coefficient.

The frequency weighting function may be determined by using frequency information of the input signal.

The frequency weighting function may be determined by using at least one selected from a perceptual characteristic and a formant distribution of the input signal.

The first weighting function may be determined based on at least one selected from a bandwidth, a coding mode, and an internal sampling frequency.

The second weighting function may be determined by using position information of adjacent ISF coefficients or LSF coefficients.

According to one or more exemplary embodiments, a method includes: obtaining a line spectral frequency (LSF) coefficient or an immitance spectral frequency (ISF) coefficient from a linear predictive coding (LPC) coefficient of an input signal; combining a first weighting function based on spectral analysis information and a second weighting function based on position information of the LSF coefficient or the ISF coefficient to determine a weighting function; and quantizing the LSF coefficient or the ISF coefficient, based on the determined weighting function.

The determining of the weighting function may be identically applied to a frame-end subframe and a mid-subframe.

The quantizing comprises applying the weighting function during directly quantizing the LSF coefficient or the ISF coefficient, in a frame-end subframe.

The quantizing may include: weighting an unquantized ISF coefficient or LSF coefficient of a mid-subframe by using the weighting function; and quantizing a weighting parameter for calculating a weighted average between quantized ISF coefficients or LSF coefficients of frame end subframes of a previous frame and a current frame, based on the weighted ISF coefficient or LSF coefficient of the mid-subframe.

The weighting parameter of the mid-subframe may be searched for in a codebook.

Advantageous Effects

According to an exemplary embodiment, it is possible to enhance a quantization efficiency of an LPC coefficient by converting the LPC coefficient to an ISF coefficient or an LSF coefficient and thereby quantizing the ISF coefficient or the LSF coefficient.

According to an exemplary embodiment, it is possible to enhance a quality of a synthesized signal based on an importance of an LPC coefficient by determining a weighting function associated with the importance of the LPC coefficient.

According to an exemplary embodiment, it is possible to enhance a quality of a synthesized signal with a few bits by quantizing a weighting parameter for obtaining a weighted average between the quantized LPC coefficient of a current frame and the quantized LPC coefficient of a previous frame, instead of directly quantizing an LPC coefficient of a mid-subframe.

According to an exemplary embodiment, it is possible to enhance a quantization efficiency of an LPC coefficient, and to accurately induce a weight of the LPC coefficient by combining a magnitude weighting function, a frequency weighting function and a weighting function based on position information of the LSF coefficient or the ISF coefficient. The magnitude weighting function indicates that an ISF or an LSF substantially affects a spectral envelope of an input signal. The frequency weighting function may use a perceptual characteristic in a frequency domain and a formant distribution.

MODE FOR INVENTION

Figure 1:
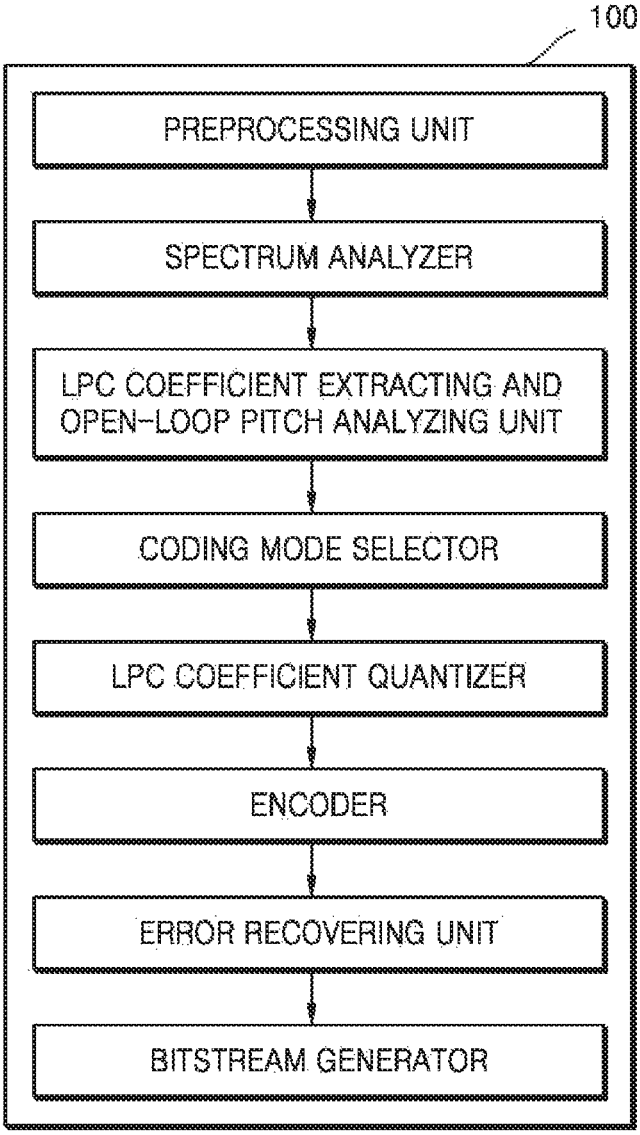
FIG. 1 illustrates a configuration of an audio signal coding apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. Like reference numerals refer to like elements throughout.

FIG. 1 illustrates a configuration of an audio signal encoding apparatus 100 according to an exemplary embodiment.

Referring to FIG. 1, the audio signal coding apparatus 100 may include a preprocessing unit 101, a spectrum analyzer 102, a linear predictive coding (LPC) coefficient extracting and open-loop pitch analyzing unit 103, a coding mode selector 104, an LPC coefficient quantizer 105, an encoder 106, an error recovering unit 107, and a bitstream generator 108. The audio signal coding apparatus 100 may be applicable to a speech signal or a speech dominated content. In addition, at some low bitrates configurations, the audio signal coding apparatus 100 may be applicable to generic audio.

The preprocessing unit 101 may preprocess an input signal. Through preprocessing, a preparation of the input signal for coding may be completed. Specifically, the preprocessing unit 101 may preprocess the input signal through high pass filtering, pre-emphasis, and sampling conversion.

The spectrum analyzer 102 may analyze a characteristic of the input signal in a frequency domain through a time-to-frequency mapping process. The spectrum analyzer 102 may determine whether the input signal is an active signal or a mute through a voice activity detection process. The spectrum analyzer 102 may remove background noise in the input signal.

The LPC coefficient extracting and open-loop pitch analyzing unit 103 may extract an LPC coefficient through a linear prediction analysis of the input signal. The LPC coefficient may indicate a spectral envelope. In general, the linear prediction analysis is performed once per frame, however, may be performed at least twice for an additional enhancement in sound quality. In this case, a linear prediction for a frame-end that is an existing linear prediction analysis may be performed for a one time, and a linear prediction for a mid-subframe for a sound quality enhancement may be additionally performed for a remaining time. A frame-end of a current frame indicates a last subframe among subframes constituting the current frame, a frame-end of a previous frame indicates a last subframe among subframes constituting the last frame.

A mid-subframe indicates at least one subframe present among subframes between the last subframe that is the frame-end of the previous frame and the last subframe that is the frame-end of the current frame. Accordingly, the LPC coefficient extracting and open-loop pitch analyzing unit 103 may extract a total of at least two sets of LPC coefficients.

The LPC coefficient extracting and open-loop pitch analyzing unit 103 may analyze a pitch of the input signal through an open loop. Analyzed pitch information may be used for searching for an adaptive codebook.

The coding mode selector 104 may select a coding mode of the input signal based on pitch information, analysis information in the frequency domain, and the like. As an exemplary embodiment, the input signal may be encoded based on the coding mode that is classified into a generic mode, a voiced mode, an unvoiced mode, or a transition mode. As another exemplary embodiment, a different excitation coding may be used to encode voiced or unvoiced speech frames, audio frames, inactive frames, etc.

The LPC coefficient quantizer 105 may quantize an LPC coefficient extracted by the LPC coefficient extracting and open-loop pitch analyzing unit 103. The LPC coefficient quantizer 105 will be further described with reference to FIG. 2 through FIG.

The encoder 106 may encode an excitation signal of the LPC coefficient based on the selected coding module. Parameters for encoding the excitation signal of the LPC coefficient may include an adaptive codebook index, an adaptive codebook again, a fixed codebook index, a fixed codebook gain, and the like. The encoder 106 may encode the excitation signal of the LPC coefficient in units of a subframe.

When there is an error frame or a lost frame in the input signal, the error recovering unit 107 may generate side information to reconstruct or conceal the error frame or the lost frame for total sound quality enhancement.

The bitstream generator 108 may generate a bitstream using the encoded signal. In this instance, the bitstream may be used for storage or transmission.

Figure 2:
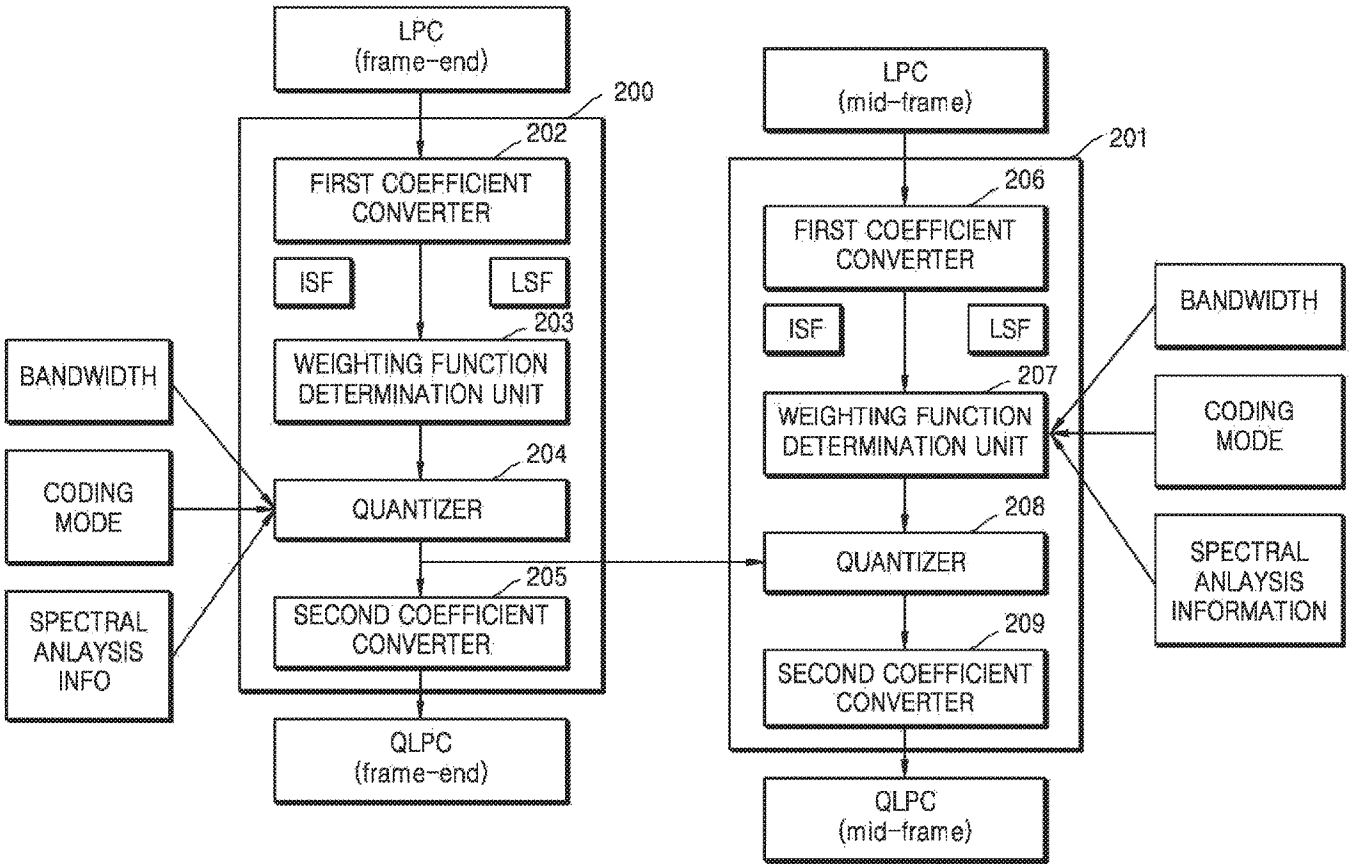
FIG. 2 illustrates a configuration of a linear predictive coding (LPC) coefficient quantizer according to an exemplary embodiment.

FIG. 2 illustrates a configuration of an LPC coefficient quantizer according to an exemplary embodiment.

Referring to FIG. 2, a quantization process including two operations may be performed. One operation relates to performing of a linear prediction for a frame-end of a current frame or a previous frame. Another operation relates to performing of a linear prediction for a mid-subframe for a sound quality enhancement.

An LPC coefficient quantizer 200 with respect to the frame-end of the current frame or the previous frame may include a first coefficient converter 202, a weighting function determination unit 203, a quantizer 204, and a second coefficient converter 205.

The first coefficient converter 202 may convert an LPC coefficient that is extracted by performing a linear prediction analysis of the frame-end of the current frame or the previous frame of the input signal. For example, the first coefficient converter 202 may convert, to a format of one of a line spectral frequency (LSF) coefficient and an immitance spectral frequency (ISF) coefficient, the LPC coefficient with respect to the frame-end of the current frame or the previous frame. The ISF coefficient or the LSF coefficient indicates a format that may more readily quantize the LPC coefficient.

The weighting function determination unit 203 may determine a weighting function associated with an importance of the LPC coefficient with respect to the frame-end of the current frame and the frame-end of the previous frame, based on the ISF coefficient or the LSF coefficient converted from the LPC coefficient. As an exemplary embodiment, the weighting function determination unit 203 may determine a magnitude weighting function and a frequency weighting function. In addition, the weighting function determination unit 203 may determine a weighting function based on position information of the LSF coefficient or the ISF coefficient. The weighting function determination unit 203 may determine a weighting function based on at least one of a bandwidth, a coding mode, and spectral analysis information.

As an exemplary embodiment, the weighting function determination unit 203 may induce an optimal weighting function for each coding mode. The weighting function determination unit 203 may induce an optimal weighting function based on a bandwidth of the input signal. The weighting function determination unit 203 may induce an optimal weighting function based on frequency analysis information of the input signal. The frequency analysis information may include spectrum tilt information.

For a mid-subframe, a weighting function determination unit 207 for determining a weighting function associated to an ISF coefficient or an LSF coefficient of the mid-subframe may operate in the same manner as the weighting function determination unit 203.

An operation of the weighting function determination unit 203 will be further described with reference to FIG. 4 and FIG. 8.

The quantizer 204 may quantize the converted ISF coefficient or LSF coefficient using the weighting function with respect to the ISF coefficient or the LSF coefficient that is converted from the LPC coefficient of the frame-end of the current frame or the LPC coefficient of the frame-end of the previous frame. As a result of quantization, an index of the quantized ISF coefficient or LSF coefficient with respect to the frame-end of the current frame or the frame-end of the previous frame may be induced.

The second converter 205 may converter the quantized ISF coefficient or the quantized LSF coefficient to the quantized LPC coefficient. The quantized LPC coefficient that is induced using the second coefficient converter 205 may indicate not simple spectrum information but a reflection coefficient and thus, a fixed weight may be used.

Referring to FIG. 2, an LPC coefficient quantizer 201 with respect to the mid-subframe may include a first coefficient converter 206, the weighting function determination unit 207 and a quantizer 208.

The first coefficient converter 206 may convert an LPC coefficient of the mid-subframe to one of an ISF coefficient or an LSF coefficient.

The weighting function determination unit 207 may determine a weighting function associated with an importance of the LPC coefficient of the mid-subframe using the converted ISF coefficient or LSF coefficient. The weighting function determination unit 207 may operate in the same manner as the weighting function determination unit 203.

The weighting function determination unit 207 may determine a weighting function of the ISF coefficient or LSF coefficient by using a spectral magnitude corresponding to a frequency of the ISF coefficient or LSF coefficient obtained from the LPC coefficient of the mid-subframe. In detail, the weighting function determination unit 207 may determine a weighting function of the ISF coefficient or LSF coefficient by using spectral magnitudes corresponding to a frequency of the ISF coefficient or LSF coefficient obtained from the LPC coefficient and a neighbouring frequency thereof. The weighting function determination unit 207 may determine a weighting function based on a maximum value, a mean, or an intermediate value of the spectral magnitudes corresponding to a frequency of the ISF coefficient or LSF coefficient obtained from the LPC coefficient and a neighbouring frequency thereof.

The process of determining a weighting function of the mid-subframe may be explained with reference to FIG. 8 and the weighting function of the mid-subframe may be determined in the same manner as the frame-end subframe shown in FIG. 4.

The weighting function determination unit 207 may determine a weighting function based on at least one of a bandwidth, a coding mode, and spectral analysis information of the mid-subframe. The frequency analysis information may include spectrum tilt information.

The weighting function determination unit 207 may determine a final weighting function by combining a magnitude weighting function determined based on spectral magnitudes and a frequency weighting function. The frequency weighting function may indicate a weighting function corresponding to a frequency of the ISF coefficient or LSF coefficient obtained from the LPC coefficient of the mid-subframe and may be expressed by a bark scale.

The quantizer 208 may quantize the converted ISF coefficient or LSF coefficient using the weighting function with respect to the ISF coefficient or the LSF coefficient that is converted from the LPC coefficient of the mid-subframe. As a result of quantization, an index of the quantized ISF coefficient or LSF coefficient with respect to the mid-subframe may be induced.

The second converter 209 may converter the quantized ISF coefficient or the quantized LSF coefficient to the quantized LPC coefficient. The quantized LPC coefficient that is induced using the second coefficient converter 209 may indicate not simple spectrum information but a reflection coefficient and thus, a fixed weight may be used.

As another exemplary embodiment, a weighting parameter for obtaining a weighted average between the quantized LPC coefficient of a current frame and the quantized LPC coefficient of a previous frame may be quantized, instead of directly quantizing an LPC coefficient of the mid-subframe. The weighting parameter may correspond to an index capable of minimizing a quantization error of the mid-subframe. In this case, there is no need of the second converter 209.

Both the weighting function determination unit 203 and the weighting function determination unit 207 may further determine a weighting function based on position information of the ISF coefficients or LSF coefficients, for example, interval information between the ISF coefficients or LSF coefficients, to then be combined with at least one of the magnitude weighting function and the frequency weighting function. A process of determining the weighting function will be described with reference to FIG. 10.

Hereinafter, a relationship between an LPC coefficient and a weighting function will be further described.

One of technologies available when encoding a speech signal and an audio signal in a time domain may include a linear prediction technology. The linear prediction technology indicates a short-term prediction. A liner prediction result may be expressed by a correlation between adjacent samples in the time domain, and may be expressed by a spectrum envelope in a frequency domain.

The linear prediction technology may include a code excited linear prediction (CELP) technology. A voice encoding technology using the CELP technology may include G.729, an adaptive multi-rate (AMR), an AMR-wideband (WB), an enhanced variable rate codec (EVRC), and the like. To encode a speech signal and an audio signal using the CELP technology, an LPC coefficient and an excitation signal may be used.

The LPC coefficient may indicate the correlation between adjacent samples, and may be expressed by a spectrum peak. When the LPC coefficient has an order of 16, a correlation between a maximum of 16 samples may be induced. An order of the LPC coefficient may be determined based on a bandwidth of an input signal, and may be generally determined based on a characteristic of a speech signal. A major vocalization of the input signal may be determined based on a magnitude and a position of a formant. To express the formant of the input signal, the order 10 of an LPC coefficient may be used with respect to an input signal of 300 to 3400 Hz that is a narrowband. The order 16 to 20 of LPC coefficients may be used with respect to an input signal of 50 to 7000 Hz that is a wideband.

A synthesis filter H(z) may be expressed by Equation 1. Here, $a_j$ denotes the LPC coefficient and p denotes the order of the LPC coefficient.

$$H(z) = \frac{1}{A(z)} = \frac{1}{1 - \sum_{j=1}^{p} a_j z^{-j}}, \quad \text{[Equation 1]}$$

-continued $$p = 10 \text{ or } 16 \sim 20$$

A synthesized signal synthesized by a decoder may be expressed by Equation 2.

$$\hat{S}(n) = \hat{u}(n) - \sum_{i=1}^{p} \hat{a}_i \hat{s}(n-i), \quad n = 0, \ldots, N-1 \quad \text{[Equation 2]}$$

Here, $\hat{S}(n)$ denotes the synthesized signal, $\hat{u}(n)$ denotes the excitation signal, and N denotes a size of a coding frame using the same coefficient. The excitation signal may be determined using a index of an adaptive codebook and a fixed codebook. A decoding apparatus may generate the synthesized signal using the decoded excitation signal and the quantized LPC coefficient.

The LPC coefficient may express formant information of a spectrum that is expressed as a spectrum peak, and may be used to encode an envelope of a total spectrum. In this instance, a coding apparatus may convert the LPC coefficient to an ISF coefficient or an LSF coefficient in order to increase an efficiency of the LPC coefficient.

The ISF coefficient may prevent a divergence occurring due to quantization through simple stability verification. When a stability issue occurs, the stability issue may be solved by adjusting an interval of quantized ISF coefficients. The LSF coefficient may have the same characteristics as the ISF coefficient except that a last coefficient of LSF coefficients is a reflection coefficient, which is different from the ISF coefficient. The ISF or the LSF is a coefficient that is converted from the LPC coefficient and thus, may maintain formant information of the spectrum of the LPC coefficient alike.

Specifically, quantization of the LPC coefficient may be performed after converting the LPC coefficient to an immitance spectral pair (ISP) or a line spectral pair (LSP) that may have a narrow dynamic range, readily verify the stability, and easily perform interpolation. The ISP or the LSP may be expressed by the ISF coefficient or the LSF coefficient. A relationship between the ISF coefficient and the ISP or a relationship between the LSF coefficient and the LSP may be expressed by Equation 3.

$$q_i = \cos(\omega_i) \quad n = 0, \ldots, N-1 \quad \text{[Equation 3]}$$

Here, $q_i$ denotes the LSP or the ISP and $\omega_i$ denotes the LSF coefficient or the ISF coefficient. The LSF coefficient may be vector quantized for a quantization efficiency. The LSF coefficient may be prediction-vector quantized to enhance a quantization efficiency. When a vector quantization is performed, and when a dimension increases, a bitrate may be enhanced whereas a codebook size may increase, decreasing a processing rate. Accordingly, the codebook size may decrease through a multi-stage vector quantization or a split vector quantization.

The vector quantization indicates a process of considering all the entities within a vector to have the same importance, and selecting a codebook index having a smallest error using a squared error distance measure. However, in the case of LPC coefficients, all the coefficients have a different importance and thus, a perceptual quality of a finally synthesized signal may be enhanced by decreasing an error of an important coefficient. When quantizing the LSF coefficients, the decoding apparatus may select an optimal codebook index by applying, to the squared error distance measure, a weighting function that expresses an importance of each LPC coefficient. Accordingly, a performance of the synthesized signal may be enhanced.

According to an exemplary embodiment, a magnitude weighting function may be determined with respect to a substantial affect of each ISF coefficient or LSF coefficient given to a spectrum envelope, based on substantial spectrum magnitude and frequency information of the ISF coefficient or the LSF coefficient. In addition, an additional quantization efficiency may be obtained by combining a frequency weighting function and a magnitude weighting function. The frequency weighting function is based on a perceptual characteristic of a frequency domain and a formant distribution. Moreover, a further quantization efficiency may be obtained by combining a weighting function considering interval information or position information of ISF coefficients or LSF coefficients with the frequency weighting function and the magnitude weighting function. Also, since an actual magnitude in a frequency domain is used, envelope information of all frequencies may be well used, and a weight of each ISF coefficient or LSF coefficient may be accurately induced.

According to an exemplary embodiment, when an ISF coefficient or an LSF coefficient converted from an LPC coefficient is vector quantized, and when an importance of each coefficient is different, a weighting function indicating a relatively important entry within a vector may be determined. An accuracy of encoding may be enhanced by analyzing a spectrum of a frame desired to be encoded, and by determining a weighting function that may give a relatively great weight to a portion with a great energy. The spectrum energy being great may indicate that a correlation in a time domain is high.

Figure 3:
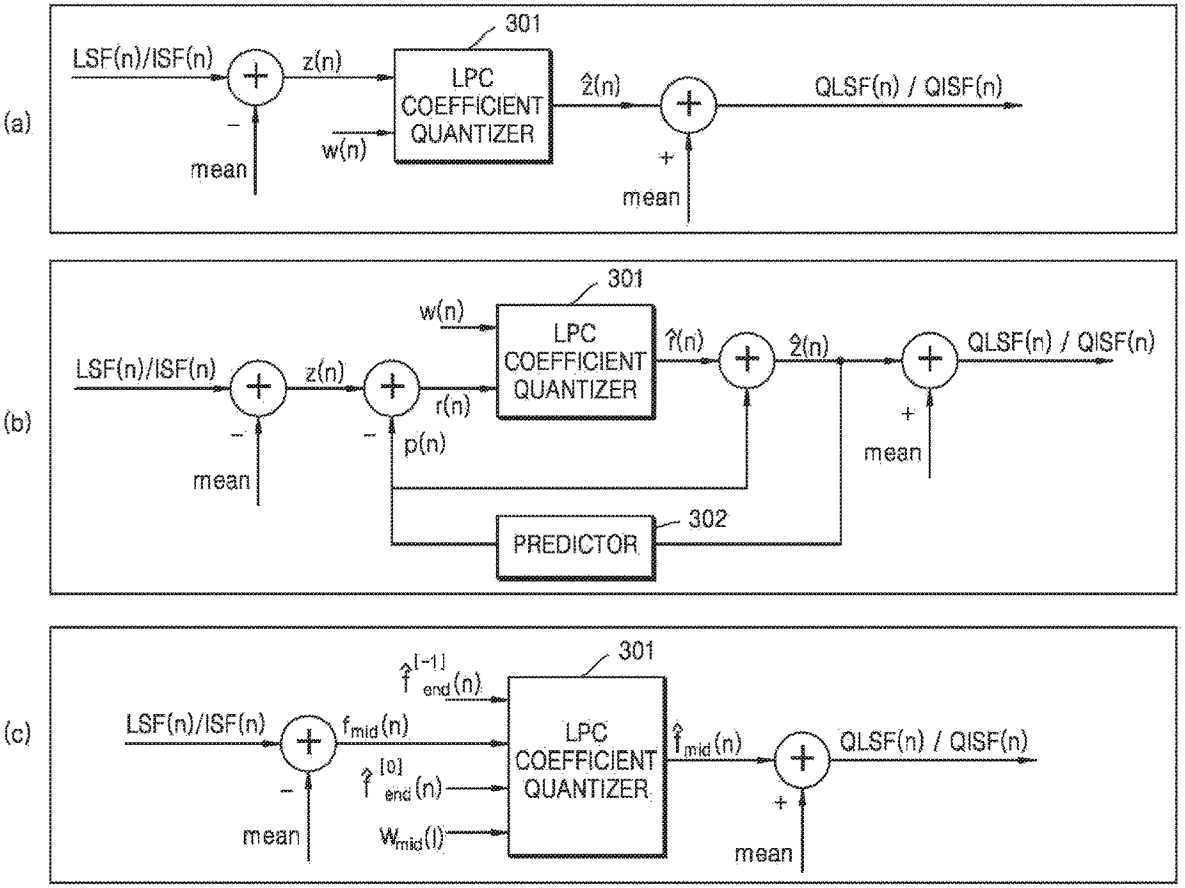
FIG. 3 illustrates a process of quantizing an LPC coefficient according to an exemplary embodiment.

FIG. 3 illustrates a process of quantizing an LPC coefficient according to an exemplary embodiment.

FIG. 3 illustrates two types of processes of quantizing the LPC coefficient. A of FIG. 3 may be applicable when a variability of an input signal is large and B of FIG. 3 may be applicable when a variability of an input signal is small. A and B of FIG. 3 may be switched and thereby be applicable depending on a characteristic of the input signal. C of FIG. 3 illustrates a process of quantizing an LPC coefficient of a mid-subframe.

An LPC coefficient quantizer 301 may quantize an ISF coefficient using a scalar quantization (SQ), a vector quantization (VQ), a split vector quantization (SVQ), and a multi-stage vector quantization (MSVQ), which may be applicable to an LSF coefficient alike.

A predictor 302 may perform an auto regressive (AR) prediction or a moving average (MA) prediction. Here, a prediction order denotes an integer greater than or equal to '1'.

An error function for searching for a codebook index through a quantized ISF coefficient of A of FIG. 3 may be given by Equation 4. An error function for searching for a codebook index through a quantized ISF coefficient of B of FIG. 3 may be expressed by Equation 5. The codebook index denotes a minimum value of the error function.

An error function induced through quantization of a mid-subframe that is used in International Telecommunication Union Telecommunication Standardization sector (ITU-T) G.718 of C of FIG. 3 may be expressed by Equation 6. Referring to Equation. 6, an index of an interpolation weight set minimizing an error with respect to a quantization error of the mid-subframe may be induced using an ISF value that is quantized with respect to a frame-end of a current frame, and an ISF value that is quantized with respect to a frame-end of a previous frame.

$$E_{werr}(k) = \sum_{n=0}^{p} w(n)[z(n) - c_z^k(n)]^2 \quad \text{[Equation 4]}$$

$$E_{werr}(p) = \sum_{i=0}^{p} w(i)[r(i) - c_r^p(i)]^2 \quad \text{[Equation 5]}$$

$$E_k^{[0]}(m) = \sum_{i=M_k}^{M_i+P_k-1} w_{mid}(l)\left[f_{mid}^{[0]}(l) - \left[(1-\alpha_k(m))\hat{f}_{end}^{[-1]}(l) + \alpha_k(m)\hat{f}_{end}^{[0]}(l)\right]\right]^2$$

Here, w(n) denotes a weighting function, z(n) denotes a vector in which a mean value is removed from ISF(n) as shown in FIG. 3, c(n) denotes a codebook, and p denotes an order of an ISF coefficient and uses 10 in a narrowband and 16 to 20 in a wideband.

According to an exemplary embodiment, a coding apparatus may determine an optimal weighting function by combining a magnitude weighting function using a spectrum magnitude corresponding to a frequency of the ISF coefficient or the LSF coefficient that is converted from the LPC coefficient, and a frequency weighting function using a perceptual characteristic of an input signal and a formant distribution.

Figure 4:
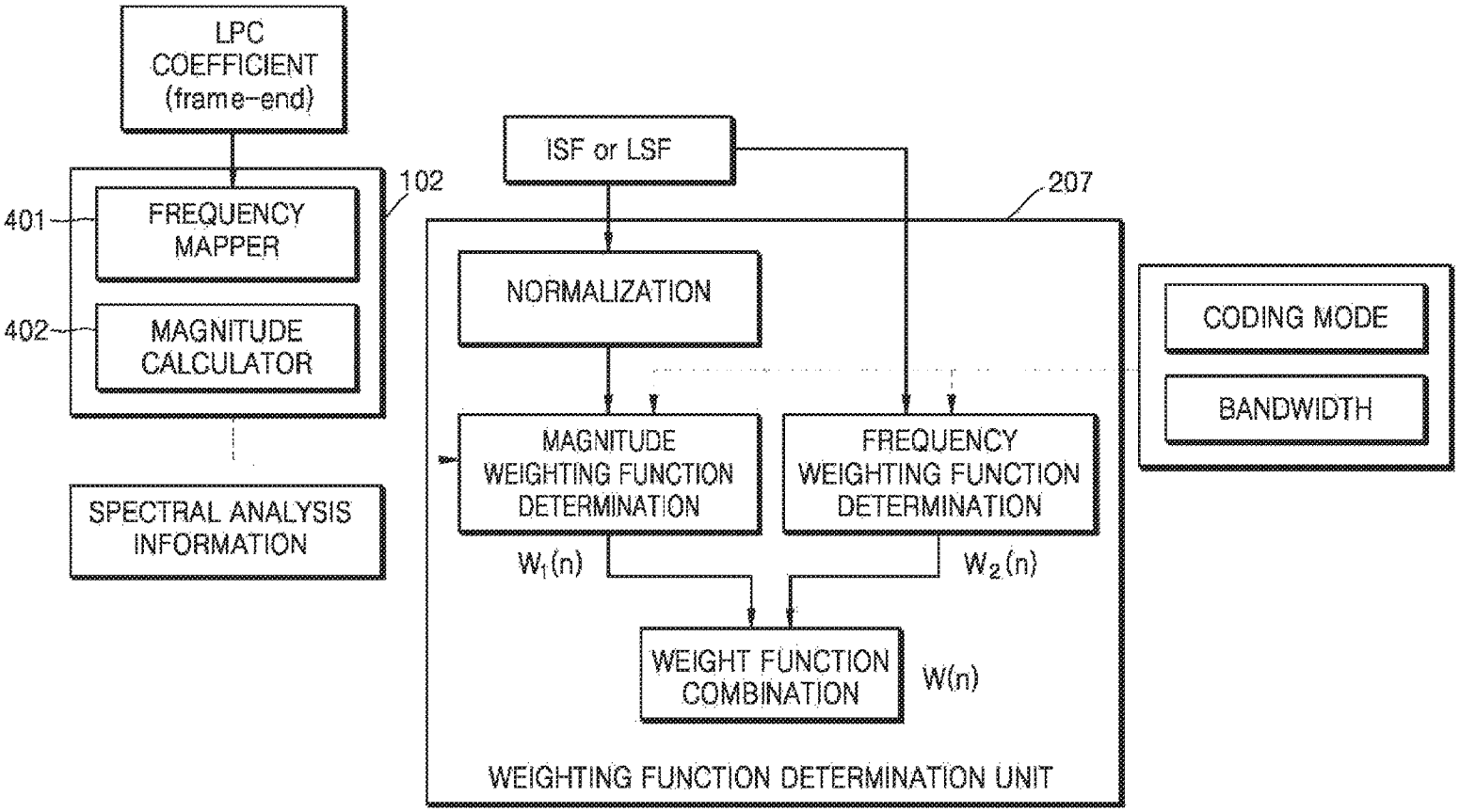
FIG. 4 illustrates a process of determining, by a weighting function determination unit of FIG. 2, a weighting function according to an exemplary embodiment.

FIG. 4 illustrates a process of determining, by the weighting function determination unit 203 of FIG. 2, a weighting function according to an exemplary embodiment.

FIG. 4 illustrates a detailed configuration of the spectrum analyzer 102. The spectrum analyzer 102 may include a frequency mapper 401 and a magnitude calculator 402.

The frequency mapper 401 may map an LPC coefficient of the frame-end subframe into a frequency domain signal. As an exemplary embodiment, the frequency mapper 401 may transform the LPC coefficient of the frame-end subframe into the frequency domain signal by using a Fast Fourier transform (FFT) or a Modified Discrete Cosine Transform (MDCT) and determine the LPC spectral information of the frame-end subframe. If 64-point FFT instead of 256-point FFT is applied to the frequency mapper 401, the transform to a frequency domain may be performed in a very low complexity. The frequency mapper 401 may determine a spectral magnitude of the frame-end subframe based on the LPC spectral information.

The magnitude calculator 402 may calculate a magnitude of a frequency spectra bin based on the spectral magnitude of the frame-end subframe. A number of frequency spectral bins may be determined to be the same as a number of frequency spectral bins corresponding to a range set by the weighting function determination unit 207 in order to normalize the ISF coefficient or the LSF coefficient.

The magnitude of the frequency spectral bin that is spectral analysis information induced by the magnitude calculator 402 may be used when the weighting function determination unit 207 determines the magnitude weighting function.

The weighting function determination unit 203 may normalize the ISF coefficient or the LSF coefficient converted from the LPC coefficient of the frame-end subframe. During this process, a last coefficient of ISF coefficients is a reflection coefficient and thus, the same weight may be applicable.

The above scheme may not be applied to the LSF coefficient. In p order of ISF, the present process may be applicable to a range of 0 to p−2. To employ spectral analysis information, the weighting function determination unit 203 may perform a normalization using the same number K as the number of frequency spectral bins induced by the magnitude calculator 402.

The weighting function determination unit 203 may determine a per-magnitude weighting function $W_1(n)$ of the ISF coefficient or the LSF coefficient affecting a spectral envelope with respect to the frame-end subframe, based on the spectral analysis information transferred via the magnitude calculator 402. For example, the weighting function determination unit 203 may determine the magnitude weighting function based on frequency information of the ISF coefficient or the LSF coefficient and an actual spectral magnitude of an input signal. The magnitude weighting function may be determined for the ISF coefficient or the LSF coefficient converted from the LPC coefficient.

The weighting function determination unit 203 may determine the magnitude weighting function based on a magnitude of a frequency spectral bin corresponding to each frequency of the ISF coefficient or the LSF coefficient.

The weighting function determination unit 203 may determine the magnitude weighting function based on the magnitude of the spectral bin corresponding to each frequency of the ISF coefficient or the LSF coefficient, and a magnitude of at least one neighboring spectral bin adjacent to the spectral bin. In this instance, the weighting function determination unit 203 may determine a magnitude weighting function associated with a spectral envelope by extracting a representative value of the spectral bin and at least one neighboring spectral bin. For example, the representative value may be a maximum value, a mean, or an intermediate value of the spectral bins corresponding to each frequency of the ISF coefficient or the LSF coefficient and at least one neighboring spectrum bin adjacent to the spectral bin.

For example, the weighting function determination unit 203 may determine a frequency weighting function $W_2(n)$ based on frequency information of the ISF coefficient or the LSF coefficient. Specifically, the weighting function determination unit 203 may determine the frequency weighting function based on a perceptual characteristic of an input signal and a formant distribution. The weighting function determination unit 207 may extract the perceptual characteristic of the input signal by a bark scale. The weighting function determination unit 207 may determine the frequency weighting function based on a first formant of the formant distribution.

As one example, the frequency weighting function may show a relatively low weight in an extremely low frequency and a high frequency, and show the same weight in a predetermined frequency band of a low frequency, for example, a band corresponding to the first formant.

The weighting function determination unit 203 may determine an FFT based weighting function by combining the magnitude weighting function and the frequency weighting function. The weighting function determination unit 207 may determine the FFT based weighting function by multiplying or adding up the magnitude weighting function and the frequency weighting function.

As another example, the weighting function determination unit 207 may determine the magnitude weighting function and the frequency weighting function based on a coding mode of an input signal and bandwidth information, which will be further described with reference to FIG. 5.

Figure 5:
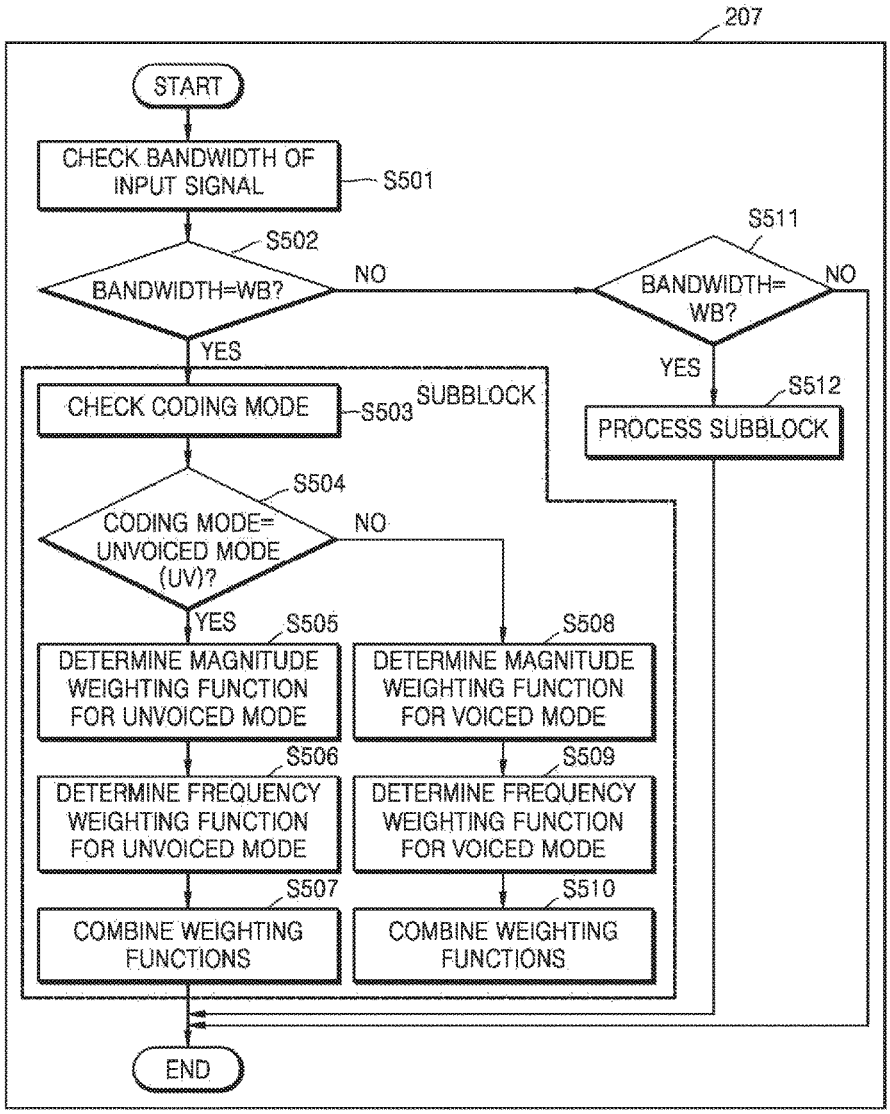
FIG. 5 illustrates a process of determining a weighting function based on an coding mode and bandwidth information of an input signal according to an exemplary embodiment.

FIG. 5 illustrates a process of determining a weighting function based on a coding mode and bandwidth information of an input signal according to an exemplary embodiment.

In operation S501, the weighting function determination unit 207 may verify a bandwidth of an input signal. In operation S502, the weighting function determination unit 207 may determine whether the bandwidth of the input signal corresponds to a wideband. When the bandwidth of the input signal does not correspond to the wideband, the weighting function determination unit 207 may determine whether the bandwidth of the input signal corresponds to a narrowband in operation S511. When the bandwidth of the input signal does not correspond to the narrowband, the weighting function determination unit 207 may not determine the weighting function. Conversely, when the bandwidth of the input signal corresponds to the narrowband, the weighting function determination unit 207 may process a corresponding sub-block, for example, a mid-subframe based on the bandwidth, in operation S512 using a process through operations S503 through S510.

When the bandwidth of the input signal corresponds to the wideband, the weighting function determination unit 207 may verify a coding mode of the input signal in operation S503. In operation S504, the weighting function determination unit 207 may determine whether the coding mode of the input signal is an unvoiced mode. When the coding mode of the input signal is the unvoiced mode, the weighting function determination unit 207 may determine a magnitude weighting function with respect to the unvoiced mode in operation S505, determine a frequency weighting function with respect to the unvoiced mode in operation S506, and combine the magnitude weighting function and the frequency weighting function in operation S507.

Conversely, when the coding mode of the input signal is not the unvoiced mode, the weighting function determination unit 207 may determine a magnitude weighting function with respect to a voiced mode in operation S508, determine a frequency weighting function with respect to the voiced mode in operation S509, and combine the magnitude weighting function and the frequency weighting function in operation S510. When the coding mode of the input signal is a generic mode or a transition mode, the weighting function determination unit 207 may determine the weighting function through the same process as the voiced mode.

For example, when the input signal is frequency converted according to the FFT scheme, the magnitude weighting function using a spectral magnitude of an FFT coefficient may be determined according to Equation 7.

$$W_1(n)=(3\cdot\sqrt{w_f(n)-\mathrm{Min}})+2,\ \mathrm{Min}=\text{Minimum value of } w_f(n)$$

where, $$w_f(n)=10\log(\max(E_{bin}(f(n),E_{bin}(f(n)+1),E_{bin}(f(n)-1))),$$

for n=0, . . . , M−2, $1\le f(n)\le 126$ $$w_f(n)=10\log(E_{bin}(f(n))),$$

for f(n)=0 or 127

$$f(n)=isf(n)/50,\ \text{then } 0\le isf(n)\le 6350,\ \text{and } 0\le f(n)\le 127$$

$$E_{BIN}(k)=X^2_R(k)+X^2_I(k),\ k=0,\ldots,127 \qquad \text{[Equation 7]}$$

Figure 6:
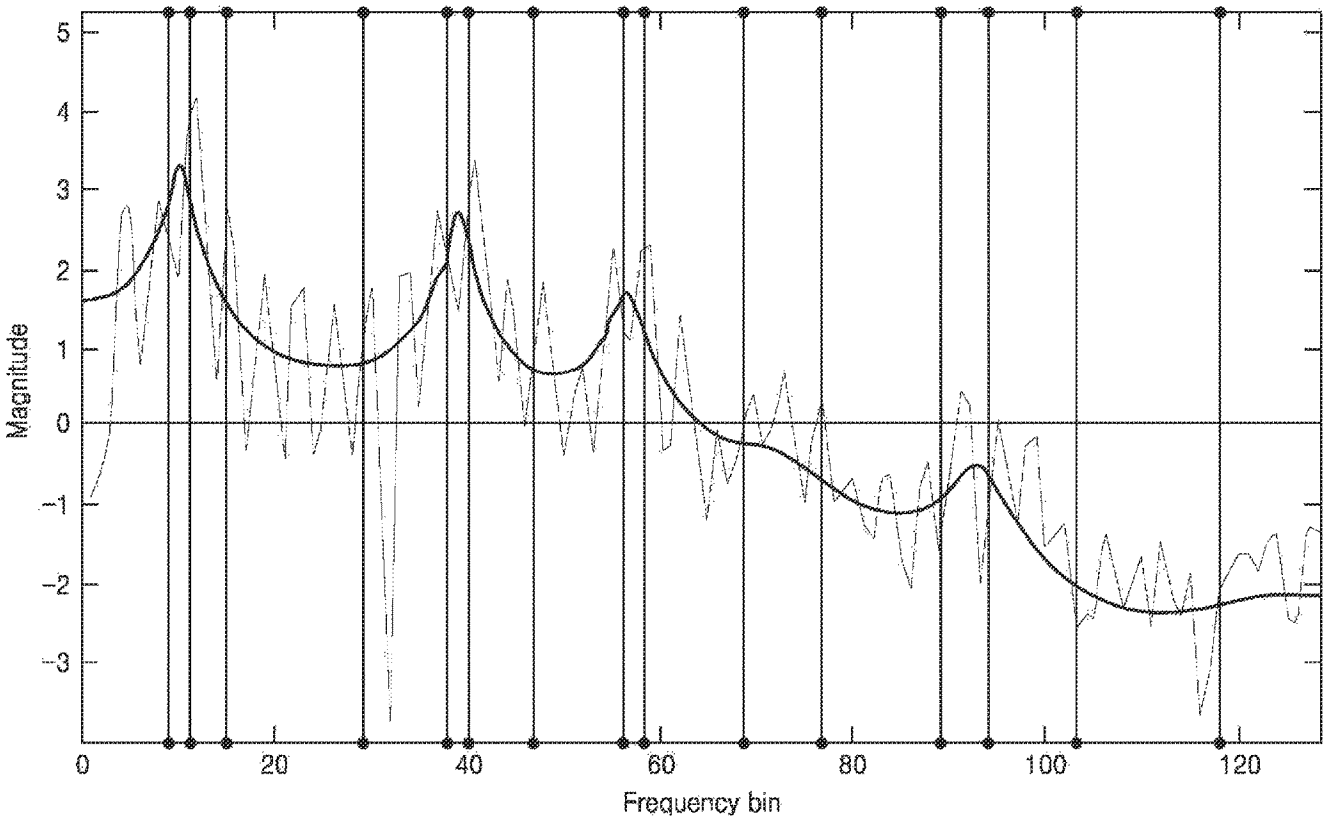
FIG. 6 illustrates an immitance spectral frequency (ISF) obtained by converting an LPC coefficient according to an exemplary embodiment.

FIG. 6 illustrates an ISF obtained by converting an LPC coefficient according to an exemplary embodiment.

Specifically, FIG. 6 illustrates a spectral result when an input signal is converted to a frequency domain according to an FFT, the LPC coefficient induced from a spectrum, and an ISF coefficient converted from the LPC coefficient. When 256 samples are obtained by applying the FFT to the input signal, and when 16 order linear prediction is performed, 16 LPC coefficients may be induced, the 16 LPC coefficients may be converted to 16 ISF coefficients.

Figure 7:
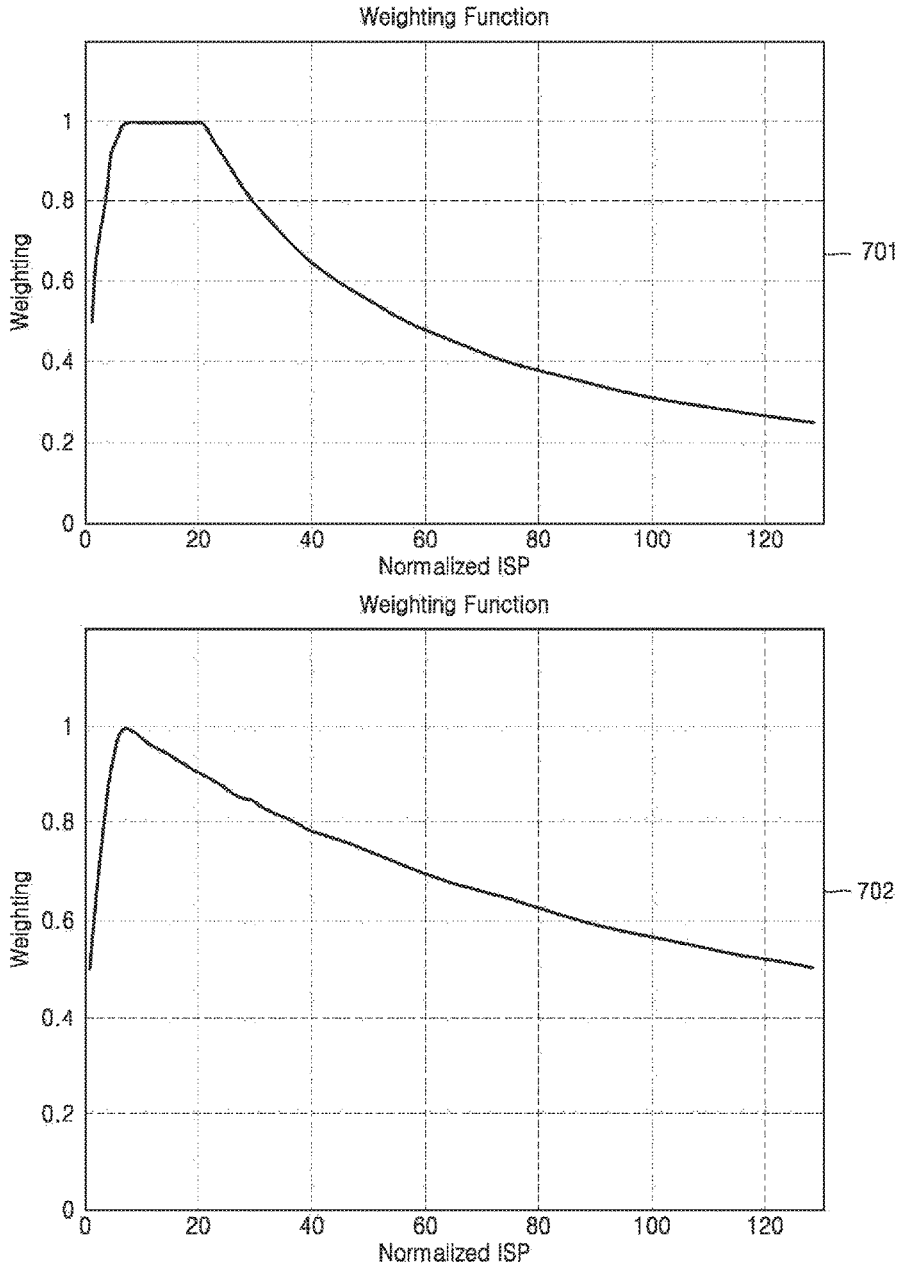
FIG. 7 illustrates a weighting function based on a coding mode according to an exemplary embodiment.

FIG. 7 illustrates a weighting function based on a coding mode according to an exemplary embodiment.

Specifically, FIG. 7 illustrates a frequency weighting function that is determined based on the coding mode of FIG. 5. A graph 701 shows a frequency weighting function in a voiced mode, and a graphing 702 shows a frequency weighting function in an unvoiced mode.

For example, the graph 701 may be determined according to Equation 8, and the graph 702 may be determined according to Equation 9. A constant in Equation 8 and Equation 9 may be changed based on a characteristic of the input signal.

$$W_2(n) = 0.5 + \frac{\sin\left(\frac{\pi \cdot f(n)}{12}\right)}{2}, \text{ for } f(n) = [0, 5]$$

$$W_2(n) = 1.0, \text{ for } f(n) = [6, 20]$$

$$W_2(n) = \frac{1}{\frac{3 \cdot (f(n) - 20)}{107} + 1}, \text{ for } f(n) = [21, 127] \quad \text{[Equation 8]}$$

$$W_2(n) = 0.5 + \frac{\sin\left(\frac{\pi \cdot f(n)}{12}\right)}{2}, \text{ for } f(n) = [0, 5]$$

$$W_2(n) = \frac{1}{\frac{(f(n) - 6)}{121} + 1}, \text{ for } f(n) = [6, 127] \quad \text{[Equation 9]}$$

If the number of the LSF coefficients is extended to 160 in an internal sampling frequency of 16 KHz, [21,127] and [6,127] may be changed into [21,159] and [6,159], respectively, in equations 8 and 9.

A weighting function finally induced by combining the magnitude weighting function and the frequency weighting function may be determined according to Equation 10.

$$W(n)=W_1(n)\cdot W_2(n), \text{ for } n=0, \ldots, M-2$$

$$W(M-1)=1.0 \quad \text{[Equation 10]}$$

Figure 8:
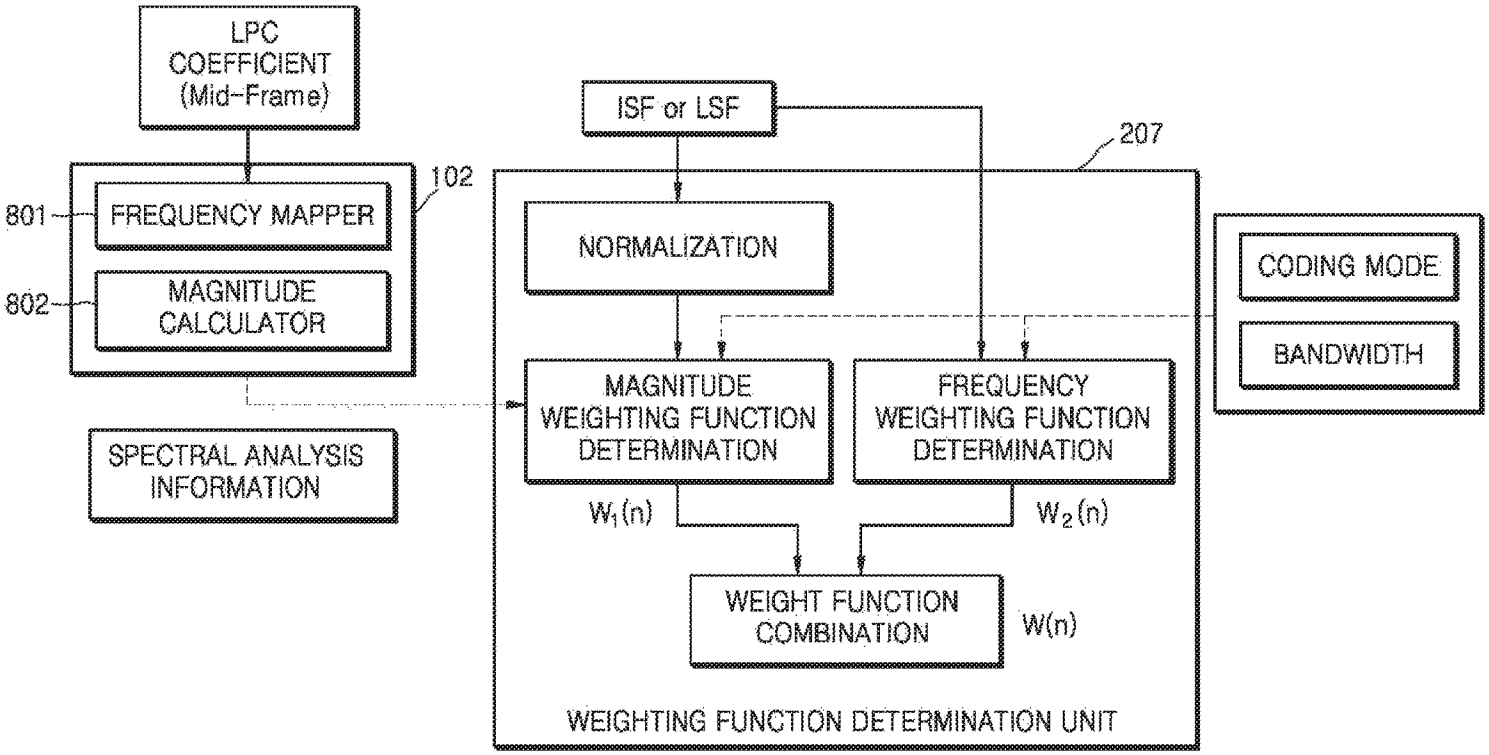
FIG. 8 illustrates a process of determining, by the weighting function determination unit of FIG. 2, a weighting function according to another exemplary embodiment.

FIG. 8 illustrates a process of determining, by the weighting function determination unit 207 of FIG. 2, a weighting function according to other an exemplary embodiment.

FIG. 8 illustrates a detailed configuration of the spectrum analyzer 102. The spectrum analyzer 102 may include a frequency mapper 801 and a magnitude calculator 802.

The frequency mapper 801 may map an LPC coefficient of a mid-subframe to a frequency domain signal. For example, the frequency mapper 801 may frequency-convert the LPC coefficient of the mid-subframe using the FFT, the MDCT, or the like, and may determine LPC spectral information about the mid-subframe. In this instance, when the frequency mapper 801 uses a 64-point FFT instead of using a 256-point FFT, the frequency conversion may be performed with a significantly small complexity. The frequency mapper 801 may determine a frequency spectral magnitude of the mid-subframe based on LPC spectral information.

The magnitude calculator 802 may calculate a magnitude of a frequency spectral bin based on the frequency spectral magnitude of the mid-subframe. A number of frequency spectral bins may be determined to be the same as a number of frequency spectral bins corresponding to a range set by the weighting function determination unit 207 to normalize an ISF coefficient or an LSF coefficient.

The magnitude of the frequency spectral bin that is spectral analysis information induced by the magnitude calculator 802 may be used when the weighting function determination unit 207 determines a magnitude weighting function.

A process of determining, by the weighting function determination unit 207, the weighting function is described above with reference to FIG. 5 and thus, further detailed description will be omitted here.

Figure 9:
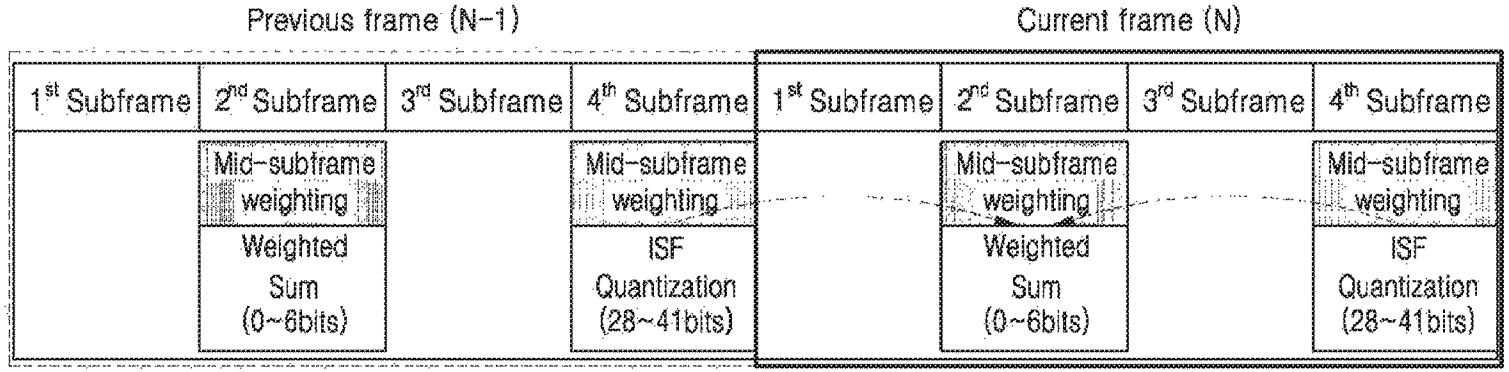
FIG. 9 is a diagram for describing an LPC coding scheme in a mid-subframe, according to an exemplary embodiment.

FIG. 9 illustrates an LPC coding scheme of a mid-subframe according to an exemplary embodiment.

A CELP coding technology is used for linear prediction and an excited signal and an LPC coefficient are used to code an input signal. When the input signal is coded, the LPC coefficient may be quantized. However, in a case of quantizing the LPC coefficient, a dynamic range is broad, and it is difficult to check the quantizing stability. Therefore, the LPC coefficient may be coded by converting the LPC coefficient into a line spectral frequency (LSF) coefficient (or an LSP) or an immitance spectral frequency (ISF) coefficient (or an ISP) that has a narrow dynamic range and allows easy check of the stability thereof.

In this case, the LPC coefficient converted into the ISF coefficient or the LSF coefficient is vector-quantized for increasing an efficiency of quantization. In such a process, when all LPC coefficients are quantized at the same significance, a quality of a finally synthesized input signal is degraded. That is, significances of all LPC coefficients differ, and thus, when an error of an important LPC coefficient is small, a quality of a synthesized input signal is enhanced. When quantization is performed by applying the same significance without considering significances of LPC coefficients, a quality of an input signal is inevitably degraded. Therefore, a weighting function for determining the significance is needed.

Generally, a communication voice coder is configured with a subframe of 5 ms and a subframe of 20 ms. AMR and AMR-WB, which are a voice coder of global system for mobile communication (GSM) and a voice coder of 3rd generation partnership project (3GPP), are configured with a frame of 20 ms which includes four subframes of 5 ms.

As shown in FIG. 9, a quantization of an LPC coefficient may be performed for a fourth subframe (a frame-end), which is a last frame among subframes configuring a previous frame and a current frame, once. An LPC coefficient for a first, second, or third subframe of a current frame is not directly quantized, and instead, an index indicating a rate associated with a weighted sum or an weighted average of quantized LPC coefficients for a frame-end of a previous frame and a frame-end of a current frame may be transmitted.

Figure 10:
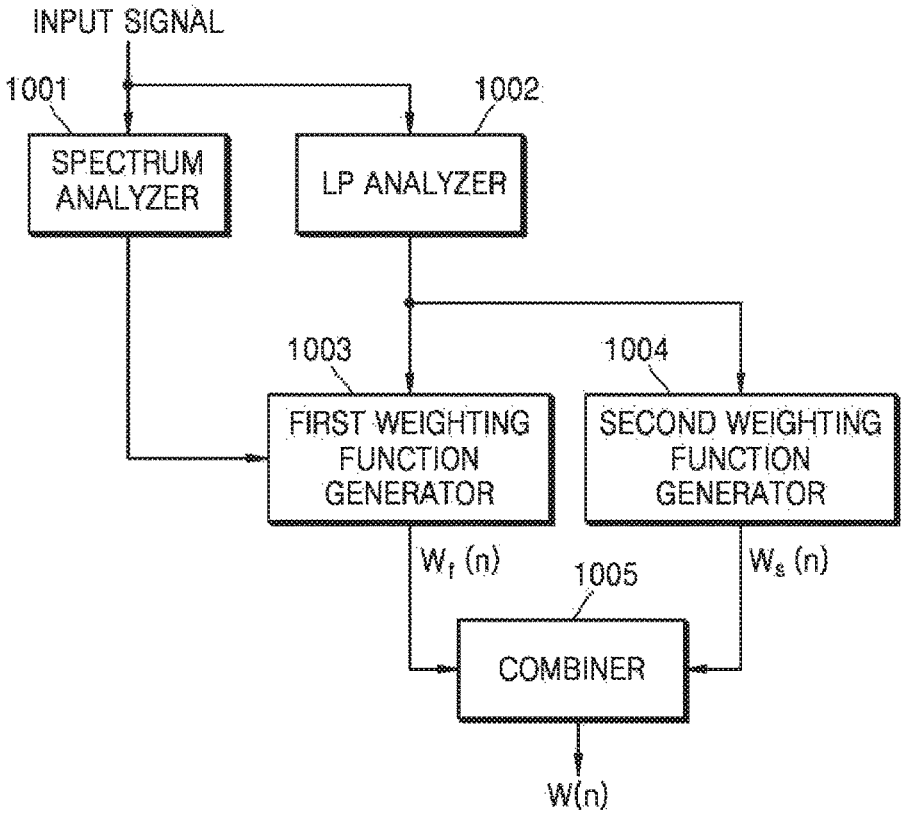
FIG. 10 is a block diagram illustrating a configuration of a weighting function determination apparatus according to an exemplary embodiment.

FIG. 10 is a block diagram illustrating a configuration of a weighting function determination apparatus according to an exemplary embodiment.

The weighting function determination apparatus of FIG. 10 may include a spectrum analyzer 1001, an LP analyzer 1002, and a weighting function determiner 1010. The weighting function determiner 1010 may include a first weighting function generator 1003, a second weighting function generator 1004, and a combiner 1005. Each of the elements may be integrated into at least one processor.

Referring to FIG. 10, the spectrum analyzer 1001 may analyze a characteristic of an input signal in a frequency domain through a time-to-frequency mapping operation. Here, the input signal may be a preprocessed signal, and the time-to-frequency mapping operation may be performed by using a Fast Fourier transform (FFT). However, the exemplary embodiment is not limited thereto. The spectrum analyzer 1001 may provide spectral analysis information, for example, a spectral magnitude which is obtained as an FFT result. Here, the spectral magnitude may have a linear scale. In detail, the spectrum analyzer 1001 may perform a 128-point FFT to generate the spectral magnitude. In this case, a bandwidth of the spectral magnitude may correspond to a range of 0 Hz to 6,400 Hz. When an internal sampling frequency is 16 kHz, the number of spectral magnitudes may be expanded to 160. In this case, a spectral magnitude for a range of 6,400 Hz to 8,000 Hz may be omitted, and the omitted spectral magnitude may be generated by an input spectrum. In detail, the omitted spectral magnitude for the range of 6,400 Hz to 8,000 Hz may be replaced by using last thirty-two spectral magnitudes corresponding to a bandwidth of 4,800 Hz to 6,400 Hz. For example, an average value of the last thirty-two spectral magnitudes may be used.

The LP analyzer 1002 may perform LP analysis on the input signal to generate an LPC coefficient. The LP analyzer 1002 may generate an ISF coefficient or an LSF coefficient from the LPC coefficient.

The weighting function determiner 1010 may determine a final weighting function, which is used for a quantization of the LSF coefficient, from a first weighting function "$W_f(n)$" which is generated based on spectral analysis information for the ISF coefficient or the LSF coefficient and a second weighting function "$W_s(n)$" which is generated based on the ISF coefficient or the LSF coefficient. For example, the first weigh function may be determined by using a magnitude of a frequency corresponding to each LSF coefficient or LSF coefficient, after the spectral analysis information, namely, a spectral magnitude, is normalized to be matched with an ISF band or an LSF band. The second weighting function may be determined based on information about an interval between adjacent ISF coefficients or LSF coefficients, or a position of the adjacent ISF coefficients or LSF coefficients.

The first weighting function generator 1003 may obtain a magnitude weighting function and a frequency weighting function and combine the magnitude weighting function and the frequency weighting function to generate the first weighting function. The first weighting function may be obtained based on an FFT, and as a spectral magnitude becomes larger, a larger weight value may be allocated.

The second weighting function generator 1004 may generate the second weighting function associated with spectral sensitivity from two ISF coefficients or LSF coefficients adjacent to each ISF coefficient or LSF coefficient. Generally, an ISF coefficient or an LSF coefficient is disposed on a Z-domain unit circle, and when an interval between adjacent ISF coefficients or LSF coefficients is narrower than a periphery thereof, the ISF coefficient or the LSF coefficient appears as a spectrum peak. As a result, the second weighting function may approximate spectral sensitivities of LSF coefficients, based on positions of adjacent LSF coefficients. That is, a density of the LSF coefficients may be predicted by measuring how close adjacent LSF coefficients are from one other, and a signal spectrum may have a peak value around a frequency where there are dense LSF coefficients, whereby a large weight value may be allocated. Here, various parameters for LSF coefficients may be additionally used in determining the second weighting function, for increasing an accuracy of approximation of spectral sensitivity.

According to the above description, an interval between ISF coefficients or LSF coefficients may be inversely proportional to a weighting function. Various exemplary embodiments may be implemented by using a relationship between the interval and the weighting function. For example, the interval may be expressed as a negative number, or may be marked on a denominator. As another example, in order to further emphasize a calculated weight value, each element of a weighting function may be multiplied by a constant, or the square of each element may be calculated. As another example, a secondarily calculated weighting function may be further reflected by performing an additional arithmetic operation (for example, the power or the power of 3) on a primarily calculated weighting function itself.

An example of calculating a weighting function by using an interval between ISF coefficients or LSF coefficients is as follows.

For example, the second weighting function "$W_s(n)$" may be calculated by the following Equation 11.

$$\begin{aligned} w_i &= 3.347 - \frac{1.547}{450} d_i, \text{ for } d_i < 450 \\ &= 1.8 \cdot \frac{0.8}{1050}(d_i - 450), \text{ otherwise} \\ &\text{where } d_i = lsf_{i+1} - lsf_{i-1} \end{aligned} \quad \text{[Equation 11]}$$

Here each of $I_sf_{i-1}$ and $I_sf_{i+1}$ denotes an LSF coefficient adjacent to a current LSF coefficient "$I_sf_i$".

For example, the second weighting function "$W_s(n)$" may be calculated by the following Equation 12.

$$W_s(n) = \frac{1}{lsf_n - lsf_{n-1}} + \frac{1}{lsf_{n+1} - lsf_n}, \; n = 0, \ldots, M-1 \quad \text{[Equation 12]}$$

Here $I_sf_n$ denotes a current LSF coefficient, and each of $I_sf_{n-1}$ and $I_sf_{n+1}$ denotes an adjacent LSF coefficient, and M is 16 as an order of an LP model. For example, an LSF coefficient may be spanned between 0 and $\pi$, and thus, a first weight value and a last weight value may be calculated based on "$I_Sf_0=0$" and "$I_Sf_M=\pi$".

The combiner 1005 may combine the first weighting function and the second weighting function to determine a final weighting function which is used to quantize an LSF coefficient. In this case, examples of a combination scheme may include various schemes such as a scheme that multiplies weighting functions, a scheme that multiplies weighting functions with an appropriate ratio and then performs addition, and a scheme that multiplies each weight value by a certain value by using a lookup table and then performs addition.

Figure 11:
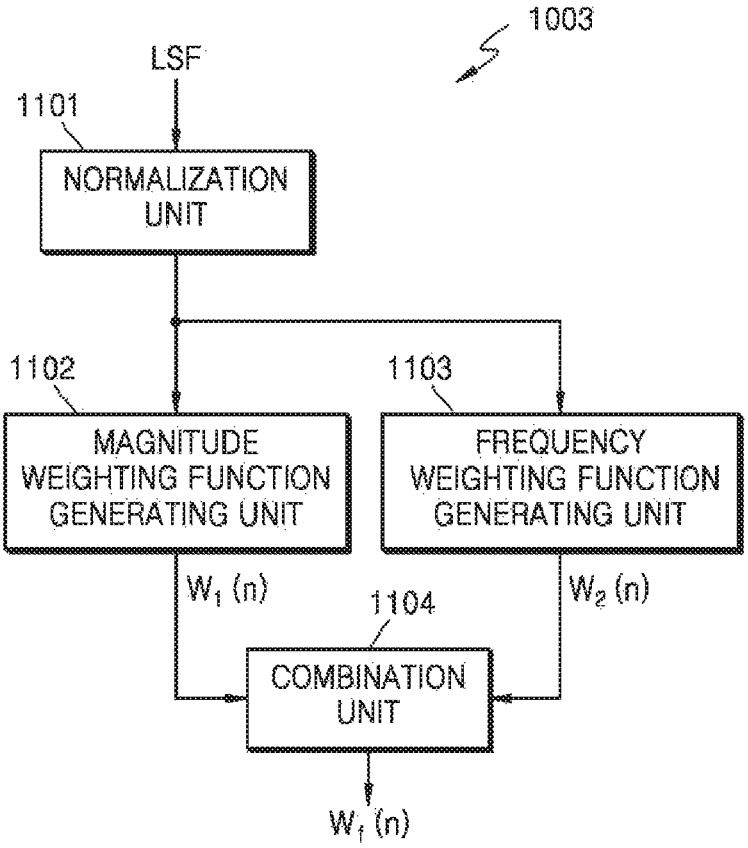
FIG. 11 is a block diagram illustrating a detailed configuration of a first weighting function generator of FIG. 10 according to an exemplary embodiment.

FIG. 11 is a block diagram illustrating a detailed configuration of the first weighting function generator 1003 of FIG. 10 according to an exemplary embodiment.

The first weighting function generator 1003 of FIG. 11 may include a normalization unit 1101, a magnitude weighting function generating unit 1102, a frequency weighting function generating unit 1103, and a combination unit 1104. Here, for convenience of a description, an LSF coefficient will be described as an example of an input signal of the first weighting function generator 1003.

Referring to FIG. 11, the normalization unit 1101 may normalize an LSF coefficient to a range of 0 to K−1. The LSF coefficient may have a range from 0 and π. In a case of an internal sampling frequency of 12.8 kHz, K is 128. In a case of an internal sampling frequency of 16.4 kHz, K is 160.

The magnitude weighting function generating unit 1102 may generate a magnitude weighting function "$W_1(n)$" for a normalized LSF coefficient, based on spectral analysis information. According to an exemplary embodiment, the magnitude weighting function may be determined based on a spectral magnitude of the normalized LSF coefficient.

In detail, the magnitude weighting function may be determined by using a magnitude of a spectral bin corresponding to a frequency of the normalized LSF coefficient and magnitudes of a left and a right of a corresponding spectral bin, for example, magnitudes of two adjacent spectral bins which are disposed at a previous position or a next position. The magnitude weighting function "$W_1(n)$" associated with a spectral envelope may be determined by extracting a maximum value from among magnitudes of three spectrum bins, based on the following Equation 13.

$$W_1(n)=(\sqrt{w_f(n)-\mathrm{Min}})+2,\ \text{for } n=0,\ldots,M-1 \qquad \text{[Equation 13]}$$

Here, Min denotes a minimum value of $w_f(n)$, and $w_f(n)$ is defined as $10\log(E_{max}(n))$ (where, n=0, . . . , M−1). Here, M is 16, and $E_{max}(n)$ denotes a maximum value of magnitudes of three spectral bins for each LSF coefficient.

The frequency weighting function generating unit 1103 may generate a frequency weighting function "$W_2(n)$" for the normalized LSF coefficient, based on frequency information. According to an exemplary embodiment, the frequency weighting function may be determined by using a weight graph which is selected by using an input bandwidth and a coding mode. An example of the weight graph is shown in FIG. 7. The weight graph may be obtained based on perceptual characteristic, such as a bark scale, or a formant distribution of an input signal. The frequency weighting function "$W_2(n)$" may be determined as expressed in Equations 8 and 9 for a voiced mode and a unvoiced mode.

The combination unit 1104 may combine the magnitude weighting function "$W_1(n)$" and the frequency weighting function "$W_2(n)$" to determine an FFT-based weighting function "$W_f(n)$". The FFT-based weighting function "$W_f(n)$" for a quantization of an LSF coefficient for a frame-end may be calculated based on the following Equation 14.

$$W_{f(n)}=W_1(n)\cdot W_2(n),\ \text{for } n=0,\ldots,M-1 \qquad \text{[Equation 14]}$$

Figure 12:
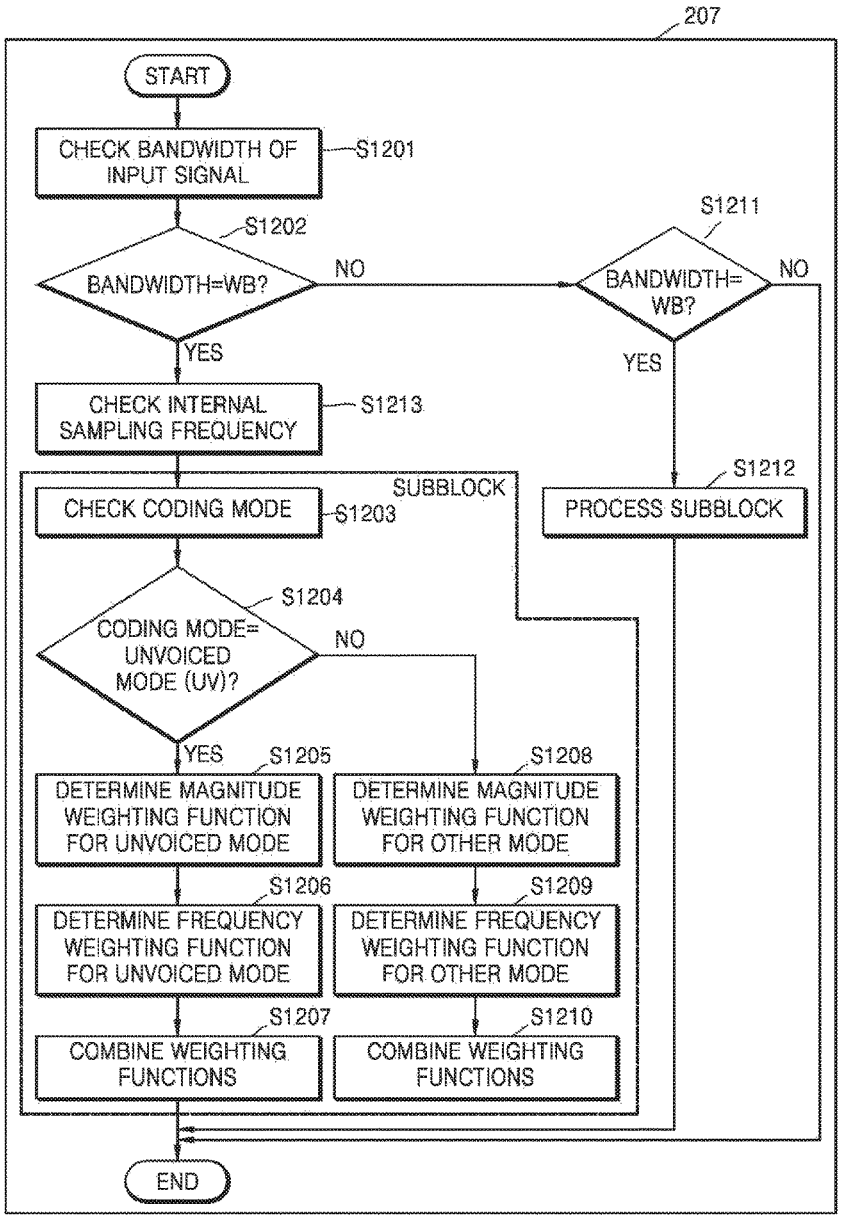
FIG. 12 is a diagram illustrating an operation of determining a weighting function by using a coding mode and bandwidth information of an input signal, according to an exemplary embodiment.

FIG. 12 is a diagram illustrating an operation of determining a weighting function by using a coding mode and bandwidth information of an input signal, according to an exemplary embodiment. In comparison with FIG. 5, operation S1213 of checking an internal sampling frequency is further added.

Referring to FIG. 12, in operation S1213, the weighting function determination apparatus may check an internal sampling frequency and adjust spectral analysis information obtained through spectrum analysis according to the internal sampling frequency or generate a signal. In operation S1213, the weighting function determination apparatus may determine the number of spectrum bins according to the internal sampling frequency for coding. For example, the number of spectrum bins based on the internal sampling frequency may be determined as shown in the following Table 1.

TABLE 1

| | | SAMPLING FREQUENCY OF INPUT SIGNAL FOR SPECTRUM ANALYSIS | |
|---|---|---|---|
| NUMBER OF SPECTRUM BINS | | 12.8 kHz | 16 kHz |
| INTERNAL SAMPLING FREQUENCY FOR CODING | 12.8 kHz | 128 | 128/160 |
| | 16 kHz | 160 | 128/160 |

In detail, a signal to be referred to in a normalized ISF or LSF coefficient in a magnitude weighting function and a frequency weighting function may be changed according to whether a band of an input signal for spectrum analysis is 12.8 kHz or 16 kHz or whether an actually coded band is 12.8 kHz or 16 kHz. According to Table 1, when the sampling frequency of the input signal for spectrum analysis is 16 kHz, a problem does not occur. Therefore, in operation S1213, mapping is performed to be matched with the internal sampling frequency for coding. In this case, for convenience of a calculation, the number of spectral bins may be selected from among 128 and 160.

When the sampling frequency of the input signal for spectrum analysis is 12.8 kHz and the internal sampling frequency for coding is 16 kHz, there is no analyzed signal to be referred to at 12.8 kHz to 16 kHz, and thus, a signal may be generated by using already-obtained spectral analysis information. To this end, in operation S1213, the number of spectral bins is determined based on the internal sampling frequency for coding. Subsequently, a signal corresponding to a band from 12.8 kHz to 16 kHz is generated. In this case, a signal of an omitted part may be obtained by using the obtained spectral analysis information. For example, the signal of the omitted part may be obtained by using statistic information about a certain part of the already-obtained spectral analysis information. Examples of the statistic information may include an average value and an intermediate value, and an example of the certain part may be K pieces of spectrum information of a certain part of a band of 0 kHz to 12.8 kHz. In detail, thirty-two average values corresponding to a rearmost part of a calculated spectral magnitude may be used at 12.8 kHz to 16 kHz.

In regard to a quantization of a subframe, according to the exemplary embodiments, in a frame-end subframe, an ISF coefficient or an LSF coefficient may be directly quantized, and a weighting function may be applied. In a mid-subframe, without directly quantizing an ISF coefficient or an LSF coefficient, a weighting parameter for obtaining a weighted average of quantized ISF coefficients or LSF coefficients of frame-end subframes of a previous frame and a current frame may be quantized. In detail, an unquantized ISF coefficient or LSF coefficient of a mid-subframe may be weighted by using a weighting function, and a weighting parameter for obtaining a weighted average of quantized ISF coefficients or LSF coefficients of frame-end subframes of a previous frame and a current frame may be obtained from a codebook, based on the weighted ISF coefficient or LSF coefficient of the mid-subframe. The codebook may be searched in a closed-loop manner, and an index corresponding to a weighting parameter may be searched for in the codebook so as to minimize an error between a quantized ISF or LSF coefficient of the mid-subframe and a weighted ISF or LSF coefficient of the mid-subframe. In the mid-subframe, an index of the codebook is transmitted, and thus, a far smaller number of bits are used compared to the frame-end subframe.

The method according to the exemplary embodiments may be implemented as computer-readable codes in a computer readable medium. The computer-readable recording medium may include a program instruction, a local data file, a local data structure, or a combination thereof. The computer-readable recording medium may be specific to exemplary embodiments or commonly known to those of ordinary skill in computer software. Examples of the computer-readable recording medium include a magnetic medium, such as a hard disk, a floppy disk and a magnetic tape, an optical medium, such as a CD-ROM and a DVD, a magneto-optical medium, such as a floptical disk, and a hardware memory, such as a ROM, a RAM and a flash memory, specifically configured to store and execute program instructions. Also, a computer-readable recording medium may be a transmission medium that transmits a signal designating a program instruction, a data structure, or the like. Examples of the program instruction include machine code, which is generated by a compiler, and a high level language, which is executed by a computer using an interpreter and so on.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments. While one or more exemplary embodiments have been described with reference to the figures, it will be understood by those of ordinary skill in the art that various changes in form and details may be made therein without departing from the spirit and scope as defined by the following claims.

What is claimed is:

1. A method of encoding a linear predictive coding (LPC) coefficient in an encoding device, the method comprising:

obtaining, performed by at least one processor, a line spectral frequency (LSF) coefficient from the linear predictive coding (LPC) coefficient of a subframe in an audio signal;

obtaining a first weighting parameter of the subframe based on a spectral magnitude of the LSF coefficient;

obtaining a second weighting parameter of the subframe based on position information of adjacent LSF coefficients;

determining a weighting parameter of the subframe from a plurality of weighting parameters including the first weighting parameter of the subframe and the second weighting parameter of the subframe; and encoding the LSF coefficient based on the weighting parameter of the subframe, wherein the first weighting parameter is obtained based on a maximum value of a magnitude of a spectral bin corresponding to a frequency of the LSF coefficient and a magnitude of at least one spectral bin neighboring the spectral bin.

2. The method of claim 1 further comprising obtaining a third weighting parameter of the subframe based on frequency information of the LSF coefficient.

3. The method of claim 2 wherein the determining of the weighting parameter of the subframe comprises:

combining the first weighting parameter of the subframe and the third weighting parameter of the subframe of the subframe; and combining a result of the combining and the second weighting parameter of the subframe to determine the weighting parameter of the subframe.

4. The method of claim 1 further comprising normalizing the LSF coefficient, wherein in the obtaining of the first weighting parameter and the obtaining of the second weighting parameter, the normalized LSF coefficient is used.

5. The method of claim 1, wherein the first weighting parameter is relevant to a spectral envelope of the audio signal.

6. The method of claim 2, wherein the third weighting parameter of the subframe is determined by using at least one selected from a perceptual characteristic and a formant distribution of the audio signal.

7. The method of claim 2, wherein the third weighting parameter is determined based on at least one selected from a bandwidth, a coding mode, and an internal sampling frequency.

8. The method of claim 7, wherein the coding mode comprises a voiced mode and a unvoiced mode.

9. An apparatus of quantizing a line spectral frequency (LSF) coefficient in an encoding device, the apparatus comprising:

at least one processor configured to:

obtain an LSF coefficient from a linear predictive coding (LPC) coefficient of a subframe in an audio signal;

obtain a first weighting parameter of the subframe based on a spectral magnitude of the LSF coefficient;

obtain a second weighting parameter of the subframe based on position information of adjacent LSF coefficients;

determine a weighting parameter of the subframe from a plurality of weighting parameters including the first weighting parameter of the subframe and the second weighting parameter of the subframe; and encode the LSF coefficient based on the weighting parameter of the subframe, wherein the first weighting parameter is obtained based on a maximum value of a magnitude of a spectral bin corresponding to a frequency of the LSF coefficient and a magnitude of at least one spectral bin neighboring the spectral bin.

10. The apparatus of claim 9, wherein the at least one processor is further configured to obtain a third weighting parameter of the subframe based on frequency information of the LSF coefficient.

11. The apparatus of claim 10, wherein the at least one processor is configured to determine the weighting parameter of the subframe by combining the first weighting parameter of the subframe and the third weighting parameter of the subframe of the subframe and combining a result of the combining and the second weighting parameter of the subframe to determine the weighting parameter of the subframe.

12. The apparatus of claim 9, wherein the at least one processor is further configured to normalize the LSF coefficient and to obtain the first weighting parameter and the second weighting parameter from the normalized LSF coefficient.

13. The apparatus of claim 9, wherein the at least one processor is configured to determine the weighting parameter of the subframe in a same manner for a frame-end subframe and a mid-subframe.

14. The apparatus of claim 9, wherein the at least one processor is configured to apply the weighting parameter of the subframe during directly quantizing the LSF coefficient in a frame-end subframe.

15. The apparatus of claim 10, wherein the third weighting parameter of the subframe is determined by using at least one selected from a perceptual characteristic and a formant distribution of the audio signal.

16. The apparatus of claim 10, wherein the third weighting parameter is determined based on at least one selected from a bandwidth, a coding mode, and an internal sampling frequency.

17. The apparatus of claim 16, wherein the coding mode comprises a voiced mode and a unvoiced mode.

18. The apparatus of claim 9, wherein the at least one processor is configured to weight an unquantized LSF coefficient of a mid-subframe by using the weighting parameter of the subframe and to quantize a weighting parameter of the mid-subframe for obtaining a weighted average between quantized LSF coefficients of frame-end subframes of a previous frame and a current frame based on the weighted LSF coefficient of the mid-subframe.

19. The apparatus of claim 18, wherein the weighting parameter of the mid-subframe is searched for in a codebook.

20. A non-transitory computer-readable storage medium storing a program for executing the method of claim 1.

* * * * *